US008540058B2

(12) United States Patent
Ikonen et al.

(10) Patent No.: US 8,540,058 B2
(45) Date of Patent: Sep. 24, 2013

(54) ELEVATOR WITH A CLOSABLE OPENING IN A CAR SILL

(75) Inventors: Antti Ikonen, Hyvinkää (FI); Jouni Kalm, Hyvinkää (FI)

(73) Assignee: Kone Corporation, Helsinki (FI)

( * ) Notice: Subject to any disclaimer, the term of this patent is extended or adjusted under 35 U.S.C. 154(b) by 955 days.

(21) Appl. No.: 12/338,949

(22) Filed: Dec. 18, 2008

(65) Prior Publication Data

US 2009/0114486 A1 May 7, 2009

Related U.S. Application Data

(63) Continuation of application No. PCT/FI2007/000176, filed on Jun. 21, 2007.

(30) Foreign Application Priority Data

Jun. 21, 2006 (FI) ..... 20060609

(51) Int. Cl.
*B66B 13/28* (2006.01)
*B66B 13/06* (2006.01)
*B66B 13/12* (2006.01)

(52) U.S. Cl.
USPC ..... 187/400; 187/330; 187/334

(58) Field of Classification Search
USPC ..... 187/400, 319, 330, 334; 49/308, 49/310, 311
See application file for complete search history.

(56) References Cited

FOREIGN PATENT DOCUMENTS

| | | | | |
|---|---|---|---|---|
| CH | 339354 | | | 6/1959 |
| CH | 10-231081 | A | | 9/1998 |
| JP | 52009245 | A | * | 1/1977 |
| JP | 61-155189 | A | | 7/1986 |
| JP | 62-98683 | U | | 6/1987 |
| JP | 02239089 | A | * | 9/1990 |
| JP | 05170390 | A | * | 7/1993 |
| JP | 8-127484 | A | | 5/1996 |
| JP | 11-193192 | A | | 7/1999 |
| JP | 2000016732 | A | * | 1/2000 |
| JP | 2000-229773 | A | | 8/2000 |
| JP | 2000-351561 | A | | 12/2000 |
| WO | WO 2007147929 | A1 | * | 12/2007 |

* cited by examiner

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

An elevator in which a first gap between a car sill and a landing sill can be maintained as small as possible except at a space of the car sill which passes over a second connecting element that drives a landing door on a landing. The structure of the elevator is simple, inexpensive and reliable, wherein a second gap of the space required for the connecting element, which gap is larger than the first gap, can be closed and opened.

20 Claims, 6 Drawing Sheets

ELEVATOR WITH A CLOSABLE OPENING IN A CAR SILL

Figure 1:
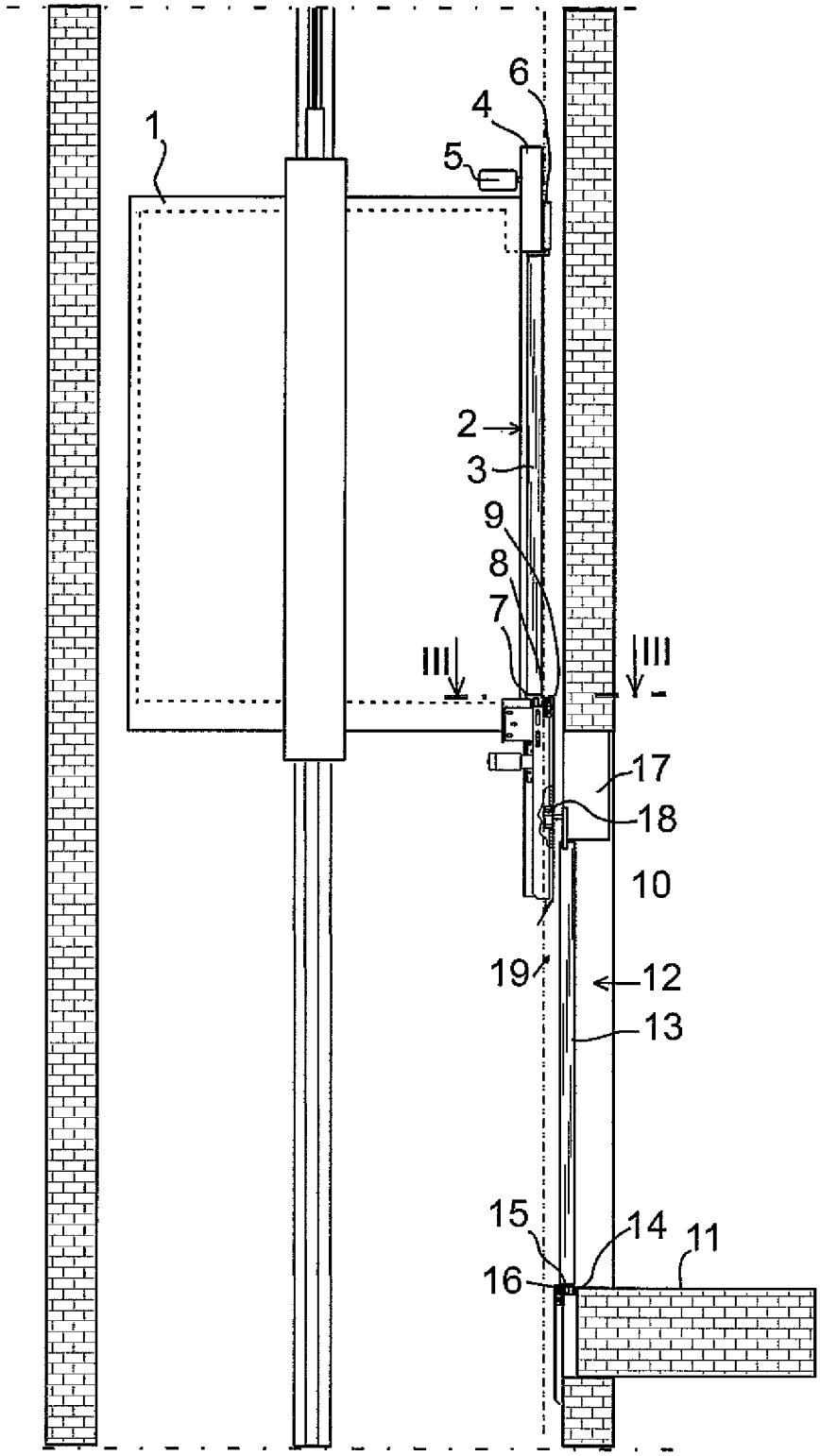

This application is a Continuation of copending PCT International Application No. PCT/FI2007/000176 filed on Jun. 21, 2007, which designated the United States, and on which priority is claimed under 35 U.S.C. §120. This application also claims priority under 35 U.S.C. §119(a) on Patent Application No(s). 20060609 filed in Finland on Jun. 21, 2006, all of which are hereby expressly incorporated by reference into the present application.

FIELD OF THE INVENTION

The present invention relates to an elevator as defined in the preamble of claim 1.

BACKGROUND OF THE INVENTION

A prior art elevator provided with automatic sliding doors. This kind of elevator incorporates a car directed to move on a vertical path in a shaft. The car contains a first door opening and a car door. The car door is a sliding door that opens and closes the first door opening. The car further contains a car door operator on the top edge of the door opening for opening and closing the sliding door. The door operator contains a drive motor and a first connecting element. The car further contains a car sill, in which is a car door guide for controlling the movement of the car door, in which car sill is a first front edge. The car further contains a footguard, which extends downwards essentially vertically from the front edge of the car sill.

The car is arranged to stop at the landings, at the points of which on each landing is a second door opening and a landing door, which is a sliding door that opens and closes the second door opening. The landing has landing sill, in which is a landing door guide for guiding the movement of the landing door, and a second front edge, which can be brought opposite and essentially to the same horizontal level as the first front edge of the car sill when the car is at a landing. On the landing is a landing door operator in the top part of the second door opening. The landing door operator contains a second connecting element, which extends in the horizontal direction over the second front edge of the landing sill into the aforementioned space in the shaft such that when the first and the second connecting elements are opposite each other the first connecting element and the second connecting element can be connected to each other for moving the landing door by means of the drive motor of the car door.

A problem with prior art in elevators provided with automatic sliding doors is that owing to the second connecting elements it is normally necessary to arrange the gap between the first front edge of the car sill and the second front edge of the landing sill to be in the order of magnitude of approx. 30 mm in size. This causes many problems. Especially in hospitals a wide gap is a drawback to moving patients' beds, drip-feed bottles and carts equipped with small wheels over the gap. Crossing the gap with an appliance that has small wheels causes unpleasant vibration, which can be life threatening to surgical patients. In homes for senior citizens the gap hampers the passage of old people with Zimmer frames. Small shoes, shoelaces and narrow high heels can get stuck in the gap. Keys and other small objects can drop into the elevator shaft via the gap.

PURPOSE OF THE INVENTION

The purpose of the invention is to eliminate the aforementioned drawbacks.

In particular one aim of the invention is to disclose an elevator in which the gap between the car sill and the landing sill can be implemented with fixed structures so as to be as small as possible at other points except at that point which passes over the second connecting element driving the landing door on the landing. Another aim is to disclose a structure that is simple in construction, inexpensive and operationally reliable, with which the gap required for the door sill by the connecting element, which is wider than the other part of the door sill, can be closed and opened. In addition, another aim of the invention is to disclose a structure that allows, if so desired, such an implementation of the sill structure that passage over it is even.

SUMMARY OF THE INVENTION

The elevator according to the invention is characterized by what is disclosed in claim 1. Other embodiments of the invention are characterized by what is disclosed in the other claims. Some inventive embodiments are also discussed in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments.

According to the invention, when the car is at the landing the first gap between the first front edge of the car sill and the second front edge of the landing sill is at most approx. 15 mm, preferably approx. 1-10 mm, in the area of the car sill which is on the side of the space into which the second connecting elements in the shaft extend in the horizontal direction. The car sill contains an opening, which is fitted to allow the passage of the car sill over the second connecting elements, in which case the second gap left between the landing sill and the car sill at the point of the aforementioned opening is greater than the first gap. The car sill comprises a closing element, which contains a covering surface essentially the size of the opening. The closing element can be moved between the open position, in which the closing element is away from the point of the opening, and the closed position, in which the closing element at the point of the opening, forming a filling of the opening such that the third gap between the closing element in the closed position and the second front edge of the landing sill is essentially as large as the first gap. In addition a turning mechanism is further arranged for moving the closing element between the open and the closed position. The closing element is further rotatably hinged to the car sill below the level of its top surface. With this structure at least one of the aforementioned advantages is achieved.

In one embodiment of the elevator the closing element comprises locking means for detaching and locking the closing element in the closed position.

In one embodiment of the elevator the closing element is hinged to the car sill below the level of its top surface to rotate in the perpendicular plane of the car sill around an essentially horizontal shaft. In one preferred embodiment of the invention this is done such that in the closed position the covering of the closing element extends to the level of the top surface of the car sill. In this case the sill structure is even and appliances passing over the sill structure do not noticeably vibrate. Also persons passing over the sill structure do not experience an unpleasant unevenness when stepping at the point of the opening.

In one embodiment of the elevator the turning mechanism comprises a turning motor, which contains a rotator shaft. The turning mechanism further comprises a crank, which is fixed to the rotator shaft. The turning mechanism also comprises a turning arm, which is rotatably hinged at its lower end to the crank at a distance from the rotator shaft, and at its upper end hinged so that it rotates with respect to the closing element.

In one embodiment of the elevator the closing element comprises a guide and a pawl, which can be moved under the direction of the guide between the detaching position and the locking position. In the detaching position the pawl is retracted inside the closing element. In the locking position the pawl protrudes from the closing element. The closing element comprises a flexible element, such as a spiral spring, which forces the pawl towards the detaching position. The car sill comprises a support element, in joint action with which the pawl is fitted to extend in the locking position. The pawl and the support element form the aforementioned locking means. The turning arm is rotatably hinged at its top end to the pawl.

In one embodiment of the elevator the closing element comprises a detent, which when the closing element is in the closed position rests from below against the edge of the opening.

In one embodiment of the elevator the turning mechanism is fitted to push the pawl in joint action with the support element into the locking position against the spring force of the flexible element when turning the closing element to the closed position.

In one embodiment of the elevator the turning motor is an electric motor. The turning mechanism comprises a first limit switch, which disconnects current from the turning motor in the open position of the closing element, and a second limit switch, which disconnects current from the turning motor in the closed position of the closing element.

In one embodiment of the elevator the turning mechanism comprises a safety circuit for preventing driving of the car when the closing element is in the closed position and for allowing driving of the car when the closing element is in the open position.

In one embodiment of the elevator the car also contains a footguard, which extends downwards essentially vertically from the front edge of the car sill, and the footguard contains a vertical chute at the point of the opening corresponding to the opening of the car sill, and which opening and chute are fitted to allow the passage of the car sill and the footguard over the second connecting elements, in which case the second gap left between the landing sill and the car sill at the point of the aforementioned opening is greater than the first gap. The chuted footguard allows the unimpeded passage over the connecting elements or over any other obstacles in the elevator shaft at the point of the chute, while however simultaneously properly implementing the required functions of a footguard.

LIST OF FIGURES

Figure 2:
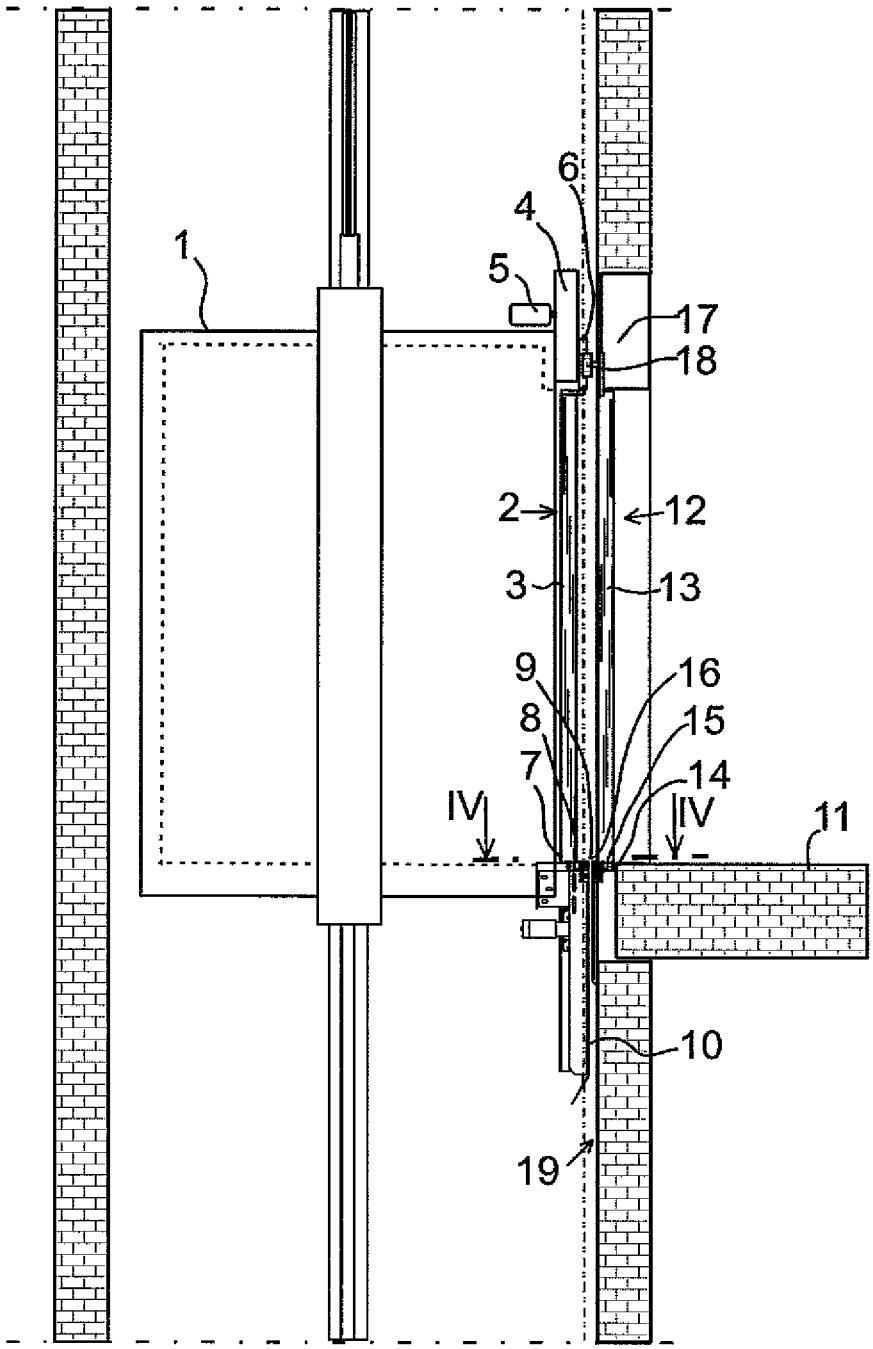
Figure 3:
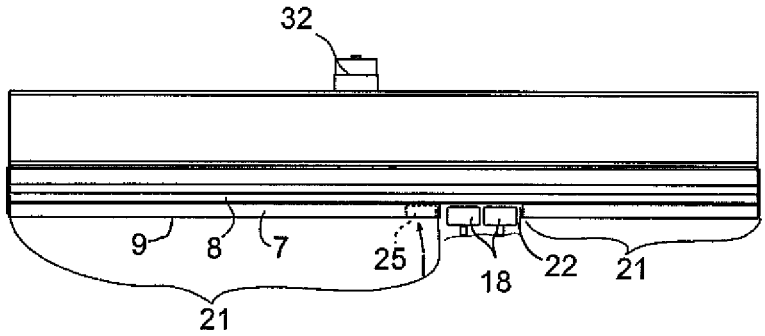
Figure 4:
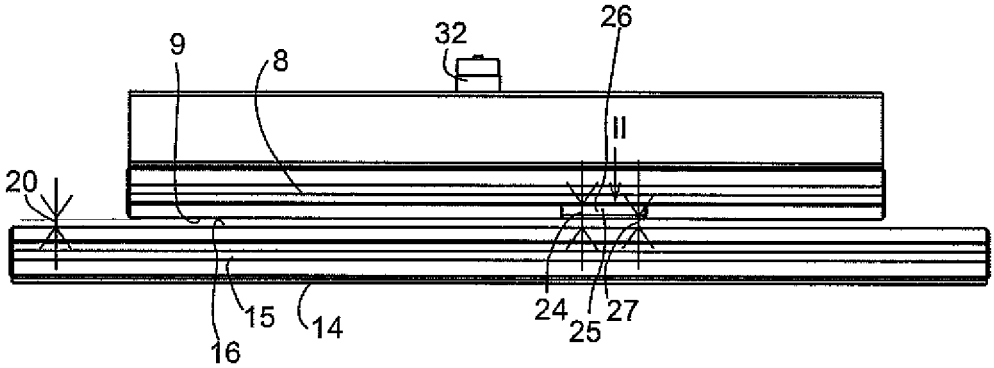
Figure 5:
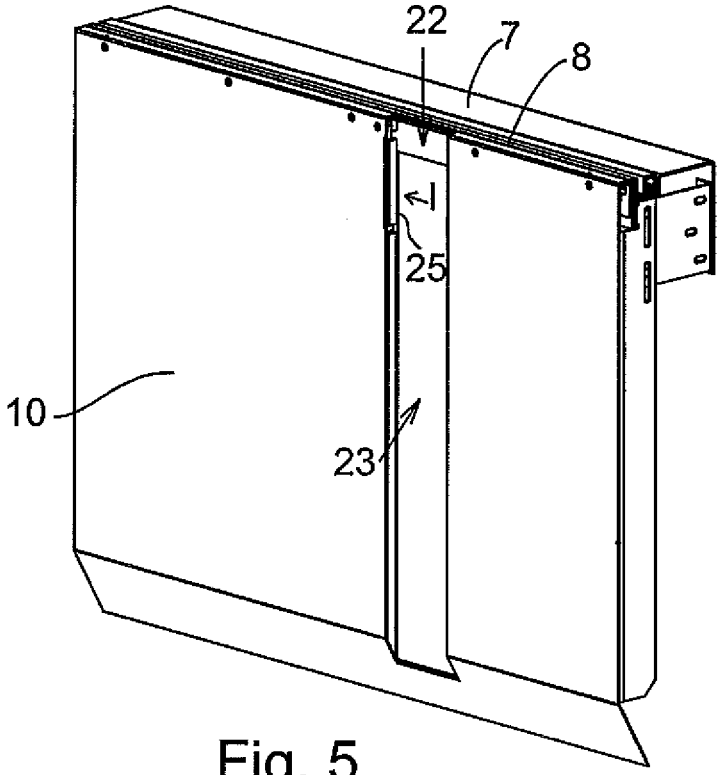
Figure 6:
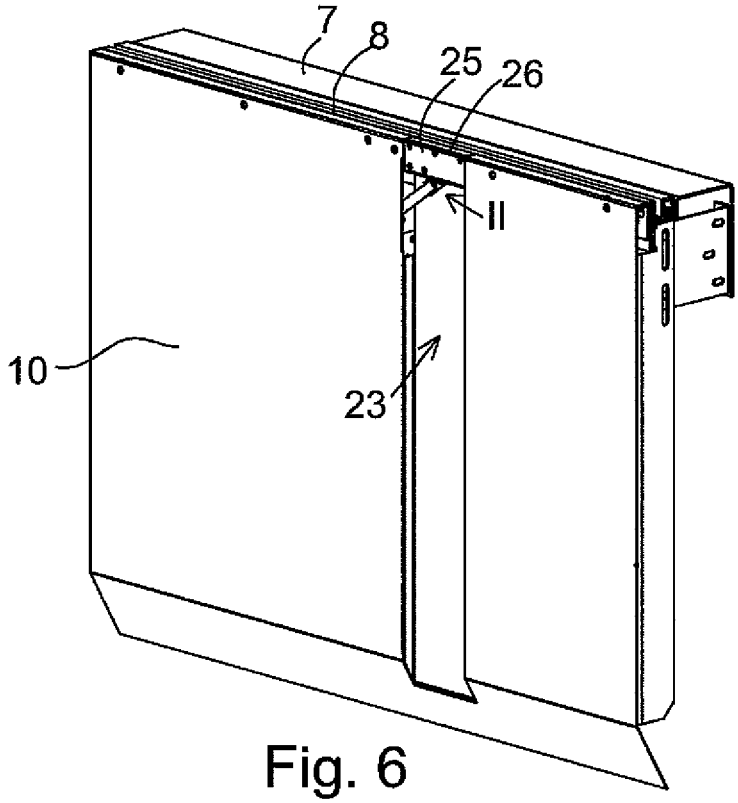
Figure 7:
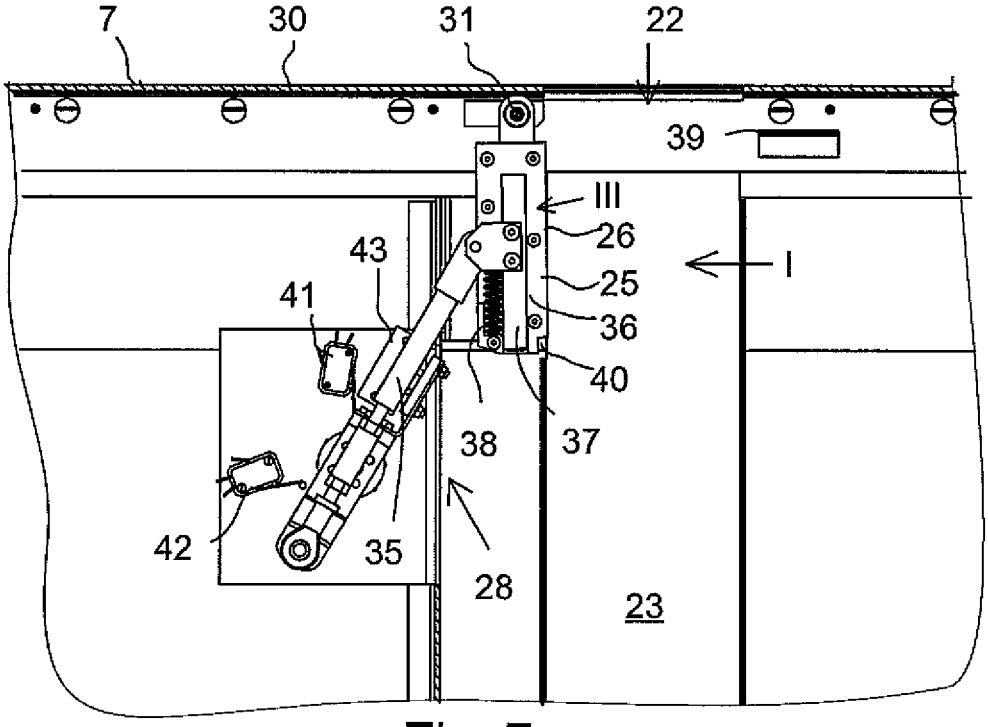
Figure 8:
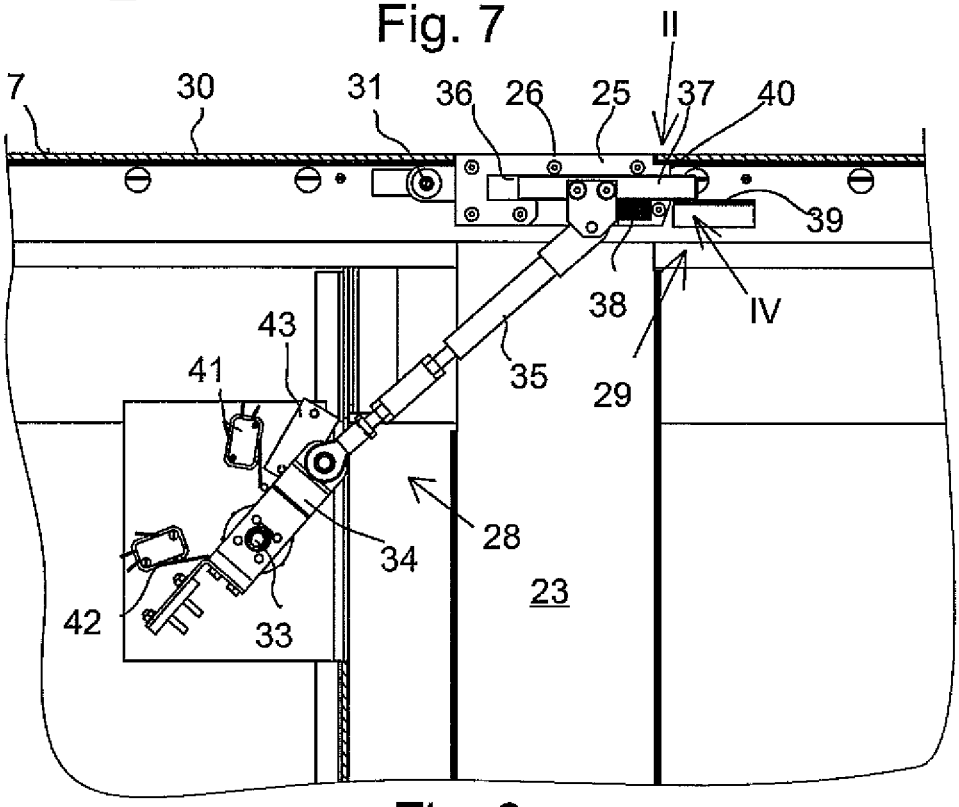
Figure 9:
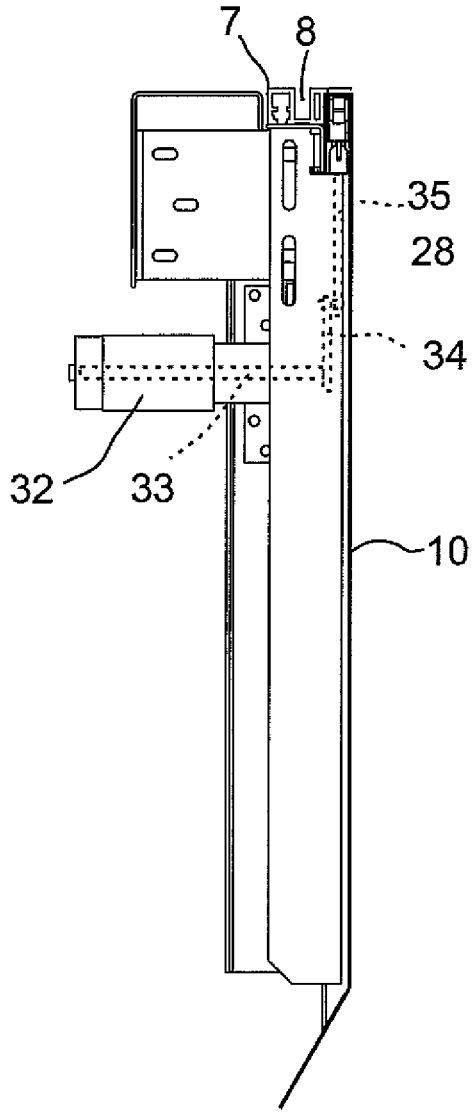

In the following, the invention will be described in detail by the aid of a few examples of its embodiments with reference to the attached drawings, wherein FIG. 1 presents one embodiment of an elevator according to the invention, in which the car is arriving at the landing or leaving from it and the footguard is passing the second connecting element of the landing door operator, FIG. 2 presents the elevator of FIG. 1 when the car is at the landing and the second connecting element of the landing door operator is coupled with the first connecting element of the car door operator, FIG. 3 presents a III-III section of FIG. 1, FIG. 4 presents an IV-IV section of FIG. 2, FIG. 5 presents an axonometric view of the assembly of the car sill and the footguard incorporated in one embodiment of the elevator according to the invention when the closing element is in the open position, FIG. 6 presents the assembly of the car sill and the footguard of FIG. 5 when the closing element is in the open position, FIG. 7 presents a detail of FIG. 6 illustrating the turning mechanism of the closing element and the locking means in the detaching position when the closing element is in the open position, FIG. 8 presents the turning mechanism and the locking means in the locking position when the closing element is in the closed position, and FIG. 9 presents a side view of the assembly of the car sill and the footguard of FIGS. 5 and 6.

DETAILED DESCRIPTION OF THE INVENTION

FIGS. 1 and 2 diagrammatically represent an elevator, which comprises a car 1, which is directed to move on a vertical path in the elevator shaft.

The car 1 contains a first door opening 2. The car 1 further contains a car door 3, which is a sliding door that opens and closes the first door opening. On the top edge of the door opening 2 is a car door operator 4 for opening and closing the sliding door. The door operator 4 contains a drive motor 5 and a first connection element 6. The car 1 further contains a car sill 7, of which a top view is also shown in FIG. 3 and which contains a car door guide 8 for guiding the movement of the car door 3. The car sill 7 contains a first front edge 9. The car 1 further contains a footguard 10, which extends essentially vertically downwards from the front edge 9 of the car sill 7 by approx. at least 0.75 m.

The elevator contains a plurality of landings 11, of which FIGS. 1 and 2 present one and at the point of which landings the car is arranged to stop. At each landing 11 is a second door opening 12. In addition at the landing 11 is a landing door 13, which is a sliding door that opens and closes the second door opening 12. Referring also to FIG. 4, the landing 11 has a landing sill 14, which contains a landing door guide 15 for guiding the movement of the landing door, and a second front edge 16, which according to FIG. 2 can be brought opposite and essentially to the same horizontal level as the first front edge 9 of the car sill 7 when the car is at the landing 11.

FIGS. 1 and 2 show that the door operator 17 is in the upper part of the second door opening 12. The landing door operator 17 contains a second connection element 18, which extends in the horizontal direction over the second front edge 16 of the landing sill 14 into the space 19 in the shaft, which is illustrated with a dot-and-dash line.

FIG. 2 shows that when the first connecting element 6 and the second connecting element 18 are opposite each other they can couple to each other for moving the landing door 13 by means of the drive motor 5 that moves the car door 3.

Referring to FIGS. 2 and 4, when the car 1 is at the landing the first gap 20 between the first front edge 9 of the car sill 7 and the second front edge 16 of the landing sill 14 is at most approx. 15 mm, preferably approx. 1-10 mm, in the area 21 of the car sill which is on the side of the space 19 into which the second connecting elements 18 in the shaft extend in the horizontal direction.

As shown in FIGS. 3-6, the car sill 7 contains an opening 22 and the footguard 10 contains a corresponding vertical chute 23 at the point of the opening 22.

As illustrated in FIG. 1, the opening 22 and the chute 23 allow the passage of the car sill 7 and the footguard 10 over the second connecting elements 18.

Referring again to FIG. 4, the second gap 24 left between the landing sill 14 and the car sill 7 at the point of the opening 22 is greater than the first gap 20.

As shown in FIGS. 3-8, the car sill 7 comprises a closing element 25, which contains a covering surface 26 essentially the size of the opening 22. The closing element 25 can be moved by means of the turning mechanism 28 between the opened position I, presented in FIGS. 3, 5 and 7, and the closed position, presented in FIGS. 4, 6 and 8. In the opened position I the closing element 25 is away from the point of the opening 22. In the closed position II the closing element 25 is at the point of the opening.

Referring to FIG. 4, in the closed position II the closing element forms a filling of the opening 22 such that the third gap 27 between the closing element 25 and the second front edge 16 of the landing sill 14 is essentially as large as the first gap 20, i.e. at most 15 mm, preferably 1-10 mm.

As shown in FIGS. 7 and 8, the closing element 25 is hinged to the car sill 7 below the level of its top surface 30 to rotate in the perpendicular plane of the car sill 7 (i.e. perpendicular to the plane of the figure) around the horizontal shaft 31 such that in the closed position II of FIG. 8 the covering surface 26 of the closing element 25 is on the level of the top surface 30 of the car sill 7.

The side view in FIG. 9 also shows that the turning mechanism 28 comprises a turning motor 32, which is an electric motor and which contains a rotator shaft 33, and a crank 34, which is fixed to the rotator shaft 33. The turning arm 35 is rotatably hinged at its lower end to the crank 34 at a distance from the rotator shaft 33. The top end of the turning arm 35 is hinged so that it rotates with respect to the closing element 25.

FIGS. 7 and 8 show that the closing element 25 can be detachably locked in the closed position II with the locking means 29. The closing element 25 comprises a guide 36. The pawl 37 can be moved under the direction of the guide 36 between the detaching position III of FIG. 7 and the locking position IV of FIG. 8. In the detaching position of FIG. 7, the pawl 37 is retracted inside the closing element 25. The pawl 37 in the locking position IV of FIG. 8 protrudes from the closing element 25. The spiral spring 38 forces the pawl 37 towards the detaching position III. The car sill 7 contains a support element 39, into joint action with which the pawl 37 extends in the locking position TV of FIG. 8. The turning arm 35 is rotatably hinged at its top end to the pawl 37. On the top edge of the free end of the closing element 25 is a detent 40, which in the closed position II (FIG. 8) of the closing element 25 rests from below against the edge of the opening 22. The turning mechanism 28 pushes the pawl 37 into joint action with the support element 39 into the locking position IV against the spring force of the spiral spring 38 when the closing element 25 is turned to the closed position IV.

As shown in FIGS. 7 and 8, the first limit switch 41 disconnects current from the turning motor 32 when the closing element 25 is in the open position I. The second limit switch 42 disconnects current from the turning motor in the closed position II of the closing element. The safety circuit 43 prevents driving of the car 1 when the closing element 25 is in the closed position I of FIG. 8. The safety circuit 43 further allows driving of the car 1 when the closing element 25 is in the open position I of FIG. 7.

It is obvious to the person skilled in the art that the invention is not limited to the embodiments described above, in which the invention is described using examples, but that many adaptations and different embodiments of the invention are possible within the scope of the inventive concept defined by the claims presented below. It is obvious to the person skilled in the art that the shaft, around which the closing element is hinged to rotate, can also be at a slightly or greatly differing angle to the horizontal. It is also obvious to the person skilled in the art that the invention can be applied to allow passage past other protrusions in the elevator shaft, or in the proximity of the landings, than the connecting elements of the landing door operator. It is further obvious to the person skilled in the art that the closing appliance arrangement according to the invention can be used separately from the footguard described or with some other footguard. It is also obvious that the footguard can at least partly form the car sill, in which case the closing element and the turning mechanism can be wholly or partly inside the footguard.

LIST OF REFERENCE NUMBERS car (1)
first door opening (2),
car door (3)
car door operator (4)
drive motor (5)
first connection element (6)
car sill (7)
car door guide (8)
first front edge (9)
footguard (10)
landing (11)
second door opening (12)
landing door (13)
landing sill (14)
landing door guide (15)
second front edge (16)
landing door operator (17)
second connection element (18)
space (19)
first gap (20)
with a wide area (21)
opening (22)
chute (23)
second gap (24)
closing element (25)
covering surface (26)
opened position (I)
closed position (II)
third gap (27)
turning mechanism (28)
locking means (29)
upper surface (30)
shaft (31)
turning motor (32)
rotator shaft (33)
crank (34)
turning arm (35)
guide (36)
pawl (37)
flexible element (38)
support element (39)
detent (40)

first limit switch (41)
second limit switch (42)
safety circuit (43)
detaching position (III)
locking position (IV)

The invention claimed is:

1. An elevator comprising:

a car directed to move on a vertical path in a shaft, wherein the car contains a first door opening, a car door, which is a sliding door that opens and closes the first door opening, a car door operator on a top edge of the first door opening for opening and closing the sliding door, the door operator containing a drive motor and a first connection element, and a car sill, which contains a car door guide for controlling movement of the car door, and a first front edge, and a plurality of landings, at a point where the car is arranged to stop, on each of the landings being a second door opening, a landing door, which is a sliding door that opens and closes the second door opening, a landing sill, which contains a landing door guide for guiding movement of the landing door, and a second front edge, which can be brought opposite and essentially to a same horizontal level as the first front edge of the car sill when the car is at the landing, and a landing door operator in a top part of the second door opening, the landing door operator containing a second connecting element, which extends in a horizontal direction over the second front edge of the landing sill into a space in the shaft such that when the first and the second connecting elements are opposite each other the first connecting element and the second connecting element can be coupled to each other for moving the landing door by the drive motor of the car door, wherein when the car is at the landing, a first gap of at most 15 mm exists between the first front edge of the car sill and the second front edge of the landing sill, wherein the first gap is uniform along the car sill and the landing sill, except for a space into which the second connecting element in the shaft extends in the horizontal direction;

the car sill contains an opening, which opening is fitted to allow passage of the car sill over the second connecting element, wherein a second gap left between the landing sill and the car sill along the opening is greater than the first gap, wherein the opening forms a discontinuity to the car still;

a closing element incorporated in the car sill contains a covering surface essentially a size of the opening and the closing element is movable between an open position, in which the closing element is away from a point of the opening, and a closed position, in which the closing element is at the point of the opening, wherein the covering surface fills the opening such that a third gap between the closing element in the closed position and the second front edge of the landing sill is essentially equal to the first gap, wherein, when the car is at the landing, the first gap remains the same regardless of whether the closing element is in the closed position or in the open position; and a turning mechanism for moving the closing element between the open position and the closed position; and the closing element is rotatably hinged to the car sill so that the closing element is rotatable below a level of a top surface of the car sill.

2. The elevator according to claim 1, wherein the turning mechanism comprises:

a turning motor, in which is a rotator shaft, a crank, which is fixed to the rotator shaft, and a turning arm, which is rotatably hinged at a lower end thereof to the crank at a distance from the rotator shaft and hinged at an upper end thereof so that the turning arm rotates with respect to the closing element.

3. The elevator according to claim 2, wherein the closing element comprises:

a guide, a pawl, which is movable under a direction of the guide between a detached position and a locking position, wherein in the detaching position the pawl is retracted inside the closing element, and in the locking position the pawl protrudes from the closing element, and a flexible element forcing the pawl towards the detaching position;

wherein the car sill comprises a support element, into joint action with which the pawl is fitted to extend in the locking position, with the pawl and the support element forming the locking means; and wherein the turning arm is rotatably hinged at a top end thereof to the pawl.

4. The elevator according to claim 3, wherein the closing element comprises a detent, which in the closed position of the closing element rests against an edge of the opening from below.

5. The elevator according to claim 4, wherein the turning mechanism is fitted to push the pawl into joint action with the support element into the locking position against a spring force of the flexible element when turning the closing element to the closed position.

6. The elevator according to claim 1, wherein the closing element comprises locking means for detaching the closing element for locking in the closed position.

7. The elevator according to claim 6, wherein the closing element is hinged to the car sill below the level of the top surface of the car sill to rotate around a horizontal shaft in a plane perpendicular to the car sill such that in the closed position the covering surface of the closing element is on the level of the top surface of the car sill.

8. The elevator according to claim 6, wherein the turning mechanism comprises:

a turning motor, in which is a rotator shaft, a crank, which is fixed to the rotator shaft, and a turning arm, which is rotatably hinged at a lower end thereof to the crank at a distance from the rotator shaft and hinged at an upper end thereof so that the turning arm rotates with respect to the closing element.

9. The elevator according to claim 6, wherein the turning motor is an electric motor; and the turning mechanism comprises a first limit switch, which disconnects current from the turning motor in the open position of the closing element, and a second limit switch, which disconnects current from the turning motor in the closed position of the closing element.

10. The elevator according to claim 6, wherein the turning mechanism comprises a safety circuit for preventing driving of the car when the closing element is in the closed position and for allowing driving of the car when the closing element is in the open position.

11. The elevator according to claim 1, wherein the closing element is hinged to the car sill so that the closing element is rotatable below the level of the top surface of the car sill around a horizontal shaft in a plane perpendicular to the car sill such that in the closed position the covering surface of the closing element is on the level of the top surface of the car sill.

12. The elevator according to claim 11, wherein the turning mechanism comprises:

a turning motor, in which is a rotator shaft, a crank, which is fixed to the rotator shaft, and a turning arm, which is rotatably hinged at a lower end thereof to the crank at a distance from the rotator shaft and hinged at an upper end thereof so that the turning arm rotates with respect to the closing element.

13. The elevator according to claim 11, wherein the turning motor is an electric motor; and the turning mechanism comprises a first limit switch, which disconnects current from the turning motor in the open position of the closing element, and a second limit switch, which disconnects current from the turning motor in the closed position of the closing element.

14. The elevator according to claim 11, wherein the turning mechanism comprises a safety circuit for preventing driving of the car when the closing element is in the closed position and for allowing driving of the car when the closing element is in the open position.

15. The elevator according to claim 1, wherein the turning motor is an electric motor; and the turning mechanism comprises a first limit switch, which disconnects current from the turning motor in the open position of the closing element, and a second limit switch, which disconnects current from the turning motor in the closed position of the closing element.

16. The elevator according to claim 1, wherein the turning mechanism comprises a safety circuit for preventing driving of the car when the closing element is in the closed position and for allowing driving of the car when the closing element is in the open position.

17. The elevator according to claim 1, wherein the closing element is rotatable around a horizontal shaft in a plane perpendicular plane to the car sill.

18. The elevator according to claim 1, wherein when the car is at the landing, the first gap between the first front edge of the car sill and the second front edge of the landing sill is approximately 1-10 mm.

19. The elevator according to claim 1, wherein the discontinuity to the car still formed by the opening is at an upwardly-facing top surface of the car sill.

20. An elevator comprising:

a car directed to move on a vertical path in a shaft, wherein the car contains a first door opening, a car door, which is a sliding door that opens and closes the first door opening, a car door operator on a top edge of the first door opening for opening and closing the sliding door, the door operator containing a drive motor and a first connection element, and a car sill, which contains a car door guide for controlling movement of the car door, and a first front edge, and a plurality of landings, at a point where the car is arranged to stop, on each of the landings being a second door opening, a landing door, which is a sliding door that opens and closes the second door opening, a landing sill, which contains a landing door guide for guiding movement of the landing door, and a second front edge, which can be brought opposite and essentially to a same horizontal level as the first front edge of the car sill when the car is at the landing, and a landing door operator in a top part of the second door opening, the landing door operator containing a second connecting element, which extends in a horizontal direction over the second front edge of the landing sill into a space in the shaft such that when the first and the second connecting elements are opposite each other the first connecting element and the second connecting element can be coupled to each other for moving the landing door by the drive motor of the car door, wherein when the car is at the landing, a first gap of at most 15 mm exist between the first front edge of the car sill and the second front edge of the landing sill, wherein the first gap is uniform along the car sill and the landing sill, except for a space into which the second connecting element in the shaft extends in the horizontal direction;

the car sill contains an opening, which opening is fitted to allow passage of the car sill over the second connecting element, wherein a second gap between the landing sill and the car sill along the opening is greater than the first gap, wherein the opening forms a discontinuity in the car still;

a closing element incorporated in the car sill contains a covering surface of a size essentially that of the opening and the closing element is movable between an open position, in which the closing element is away from a point of the opening, and a closed position, in which the closing element is at the point of the opening, wherein the covering surface fills the opening such that a third gap between the closing element in the closed position and the second front edge of the landing sill is essentially equal to the first gap; and a turning mechanism for moving the closing element between the open position and the closed position; and the closing element is rotatably hinged to the car sill so that the closing element is rotatable below a level of a top surface of the car sill, wherein the car contains a footguard, which extends downwards essentially vertically from the first front edge of the car sill and the footguard contains a vertical chute at the point of the opening corresponding to the opening of the car sill, and the opening of the car sill and the chute are fitted to allow passage of the car sill and the footguard over the second connecting element, in which case the second gap left between the landing sill and the car sill at the point of the opening is greater than the first gap.

* * * * *